US006708615B2

(12) United States Patent
Sugiyama

(10) Patent No.: US 6,708,615 B2
(45) Date of Patent: Mar. 23, 2004

(54) POWDER APPARATUS FOR PRINTING PRESS

(75) Inventor: Hiroyuki Sugiyama, Ibaraki (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/405,208

(22) Filed: Apr. 1, 2003

(65) Prior Publication Data

US 2003/0183103 A1 Oct. 2, 2003

(30) Foreign Application Priority Data

Apr. 2, 2002 (JP) ..... 100305/2002

(51) Int. Cl.[7] ..... B41F 35/00

(52) U.S. Cl. ..... 101/424.2; 239/104; 118/308; 118/324; 271/204

(58) Field of Search ..... 101/424.1, 424.2, 101/177, 483; 239/104; 118/300, 308, 324, 325; 271/204

(56) References Cited

U.S. PATENT DOCUMENTS 5,178,678 A * 1/1993 Koehler et al. ..... 101/177
5,964,155 A * 10/1999 Platsch ..... 101/424.2
6,182,567 B1 * 2/2001 Gunschera et al. ..... 101/232
6,415,990 B1 * 7/2002 Kiplinger ..... 239/215
6,419,220 B1 * 7/2002 Pollich ..... 271/3.17
6,505,828 B2 * 1/2003 Seitz ..... 271/204
6,591,751 B2 * 7/2003 Sugimoto ..... 101/483
6,606,946 B2 * 8/2003 Koch ..... 101/424.1
6,615,723 B1 * 9/2003 Haas ..... 101/424.2
6,637,338 B2 * 10/2003 Vell ..... 101/491
2002/0014738 A1 * 2/2002 Seitz et al. ..... 271/264

FOREIGN PATENT DOCUMENTS

JP 2578195 U 8/1998

* cited by examiner

*Primary Examiner*—Eugene H. Eickholt
(74) *Attorney, Agent, or Firm*—Blakely, Sokoloff, Taylor & Zafman

(57) ABSTRACT

A powder apparatus for a printing press includes delivery chains or a transfer cylinder, spray nozzles, and a circular columnar rotary member or transfer cylinder. The delivery chains or transfer cylinder has gripper units or grippers for holding and moving in a sheet convey direction a sheet having a printing surface. The spray nozzles spray a powder toward the printing surface of the sheet which is being conveyed by the delivery chains or transfer cylinder. The rotary member or transfer cylinder is provided downstream of the spray nozzles in the sheet convey direction and is supported rotatably. The rotary member or transfer cylinder has at least one notch that opposes the gripper units or grippers, during rotation, which move along with sheet convey operation.

11 Claims, 6 Drawing Sheets

POWDER APPARATUS FOR PRINTING PRESS

BACKGROUND OF THE INVENTION

The present invention relates to a powder apparatus for a printing press which blows powder to the printing surface of a sheet, so that undried ink will not cause setoff between sheets stacked on a pile plate in the delivery unit of the printing press.

A powder apparatus of this type for a printing press is disclosed in Japanese Utility Model Registration No. 2578195 (reference 1). The apparatus disclosed in reference 1 has a spray for blowing powder to the printing surface of a sheet which is conveyed as it is held by the grippers of delivery chains, shielding members provided upstream and downstream of the spray in the sheet convey direction to prevent the powder from scattering, and brushes provided to the shielding members and each brought into slidable contact with the grippers of the delivery chains. In this arrangement, the powder blown from the spray toward the printing surface of the sheet is shielded by the shielding members and brushes, so it is prevented from scattering around.

In the conventional powder apparatus described above, as each brush is fixed to the corresponding shielding member, when the grippers pass through the brush, the brush is not retreated from the grippers. In this case, if the brush is positioned to come into contact with the grippers entirely, it may interfere with the grippers from traveling, and when it comes into slidable contact with the grippers, the bristles may be pulled out and scatter. For this reason, the brush can be brought into slidable contact with only part of the grippers, and accordingly can be brought close to the sheet held by the distal ends of the grippers only limitedly. A comparatively large gap is thus formed between the distal end of the brush and a paper guide that supports the sheet under conveyance. The powder may desirably scatter around through this gap.

SUMMARY OF THE INVENTION

It is an object of the present invention to provide a powder apparatus for a printing press which prevents powder scattering.

In order to achieve the above object, according to the present invention, there is provided a powder apparatus for a printing press, comprising sheet conveying means having sheet holding means for holding and moving in a sheet convey direction a sheet having a printing surface, powder spraying means for spraying powder toward the printing surface of the sheet which is being conveyed by the sheet conveying means, and a circular columnar rotary member provided downstream of the powder spraying means in the sheet convey direction and supported rotatably, the rotary member having at least one notch that opposes the sheet holding means, during rotation, which moves along with sheet convey operation.

DESCRIPTION OF THE PREFERRED EMBODIMENTS

Figure 1:
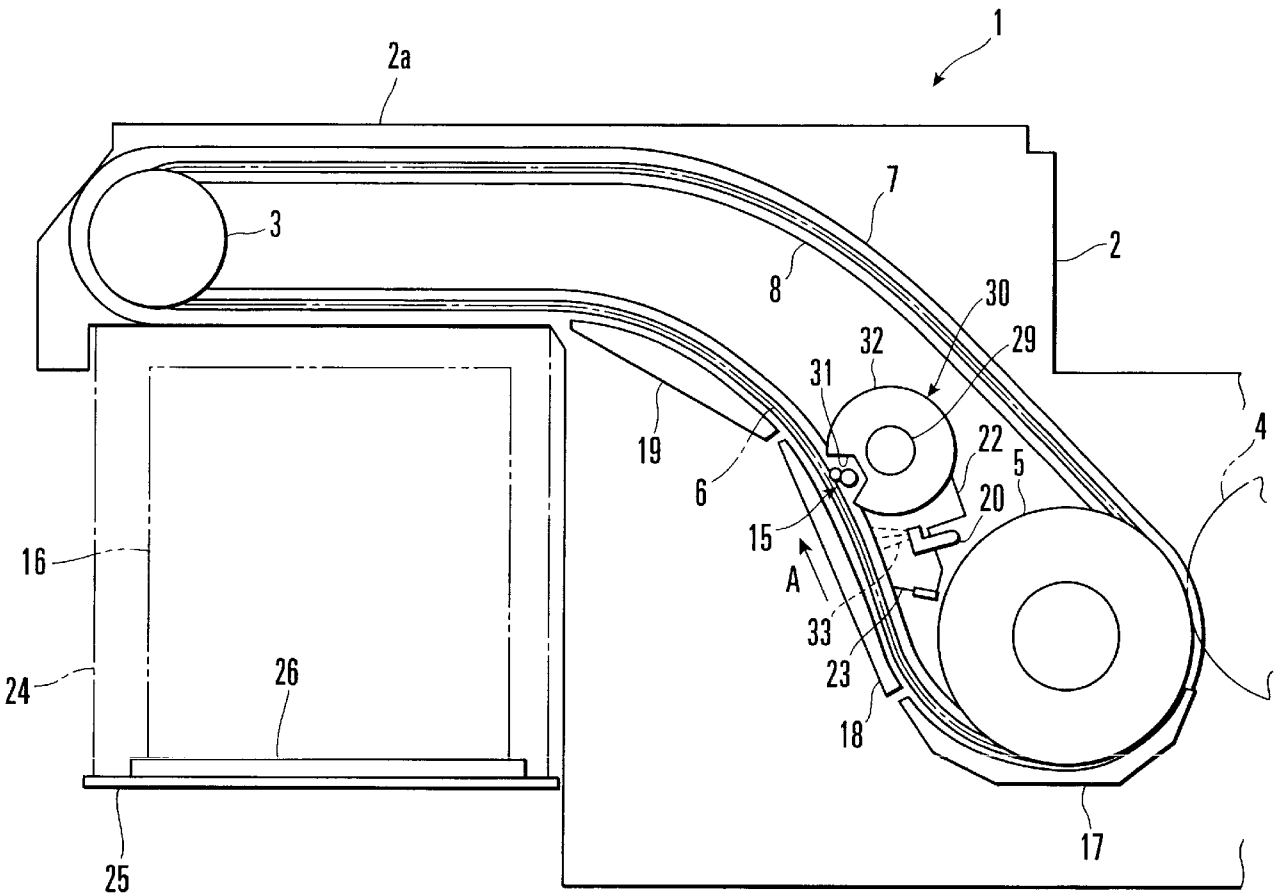
FIG. 1 is a side view of a delivery unit for a sheet-fed rotary printing press according to the first embodiment of the present invention.

A delivery unit for a printing press according to the first embodiment of the present invention will be described with reference to FIGS. 1 to 3. As shown in FIG. 1, a delivery unit 1 for the sheet-fed rotary printing press has a pair of delivery frames 2 each having a substantially inverted-L shape, when seen from the side surface. The delivery frames are connected to each other with a stay (not shown) or the like to oppose each other. A pair of sprockets 3 are rotatably, pivotally mounted on the rear ends of horizontal portions 2*a* of the pair of delivery frames 2.

Figure 2:
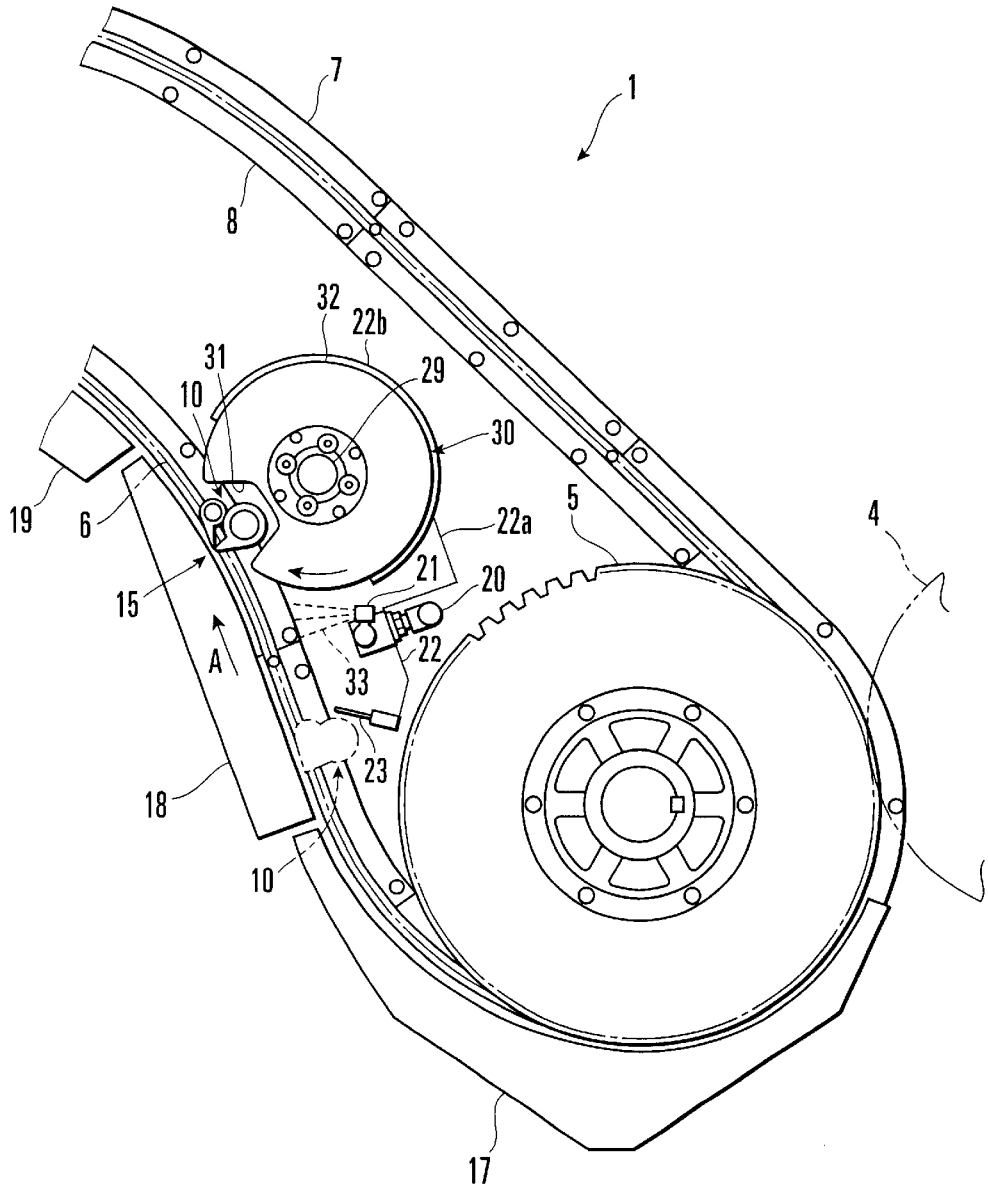
FIG. 2 is a side view of the main part of the delivery unit shown in FIG. 1.

As shown in FIG. 2, a pair of sprockets 5 are axially mounted on the two end shafts of a delivery cylinder which is in contact with a printing cylinder 4 of a final printing unit. A pair of delivery chains 6 serving as a sheet conveying means extend between the sprockets 3 and 5. The delivery chains 6 are guided as they are clamped by upper and lower chain guides 7 and 8, and travel in the direction of arrow A upon rotation of the sprockets 3 driven by the drive side.

Figure 3:
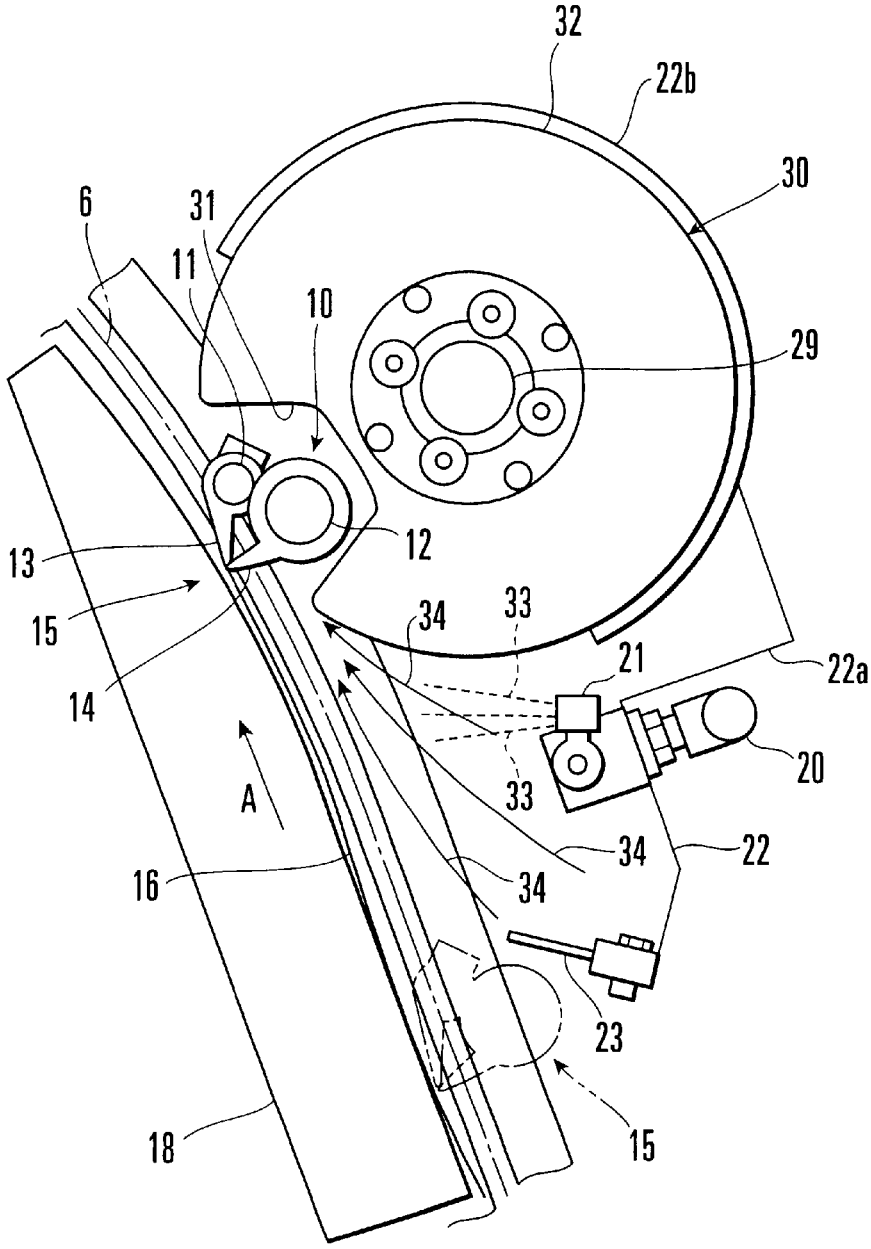
FIG. 3 is an enlarged side view for explaining powder spraying operation in the delivery unit shown in FIG. 1.

As shown in FIG. 3, a plurality of gripper bars 10 each having a gripper shaft 11 and gripper pad shaft 12 are supported between the pair of delivery chains 6 at a constant pitch. A plurality of sets of gripper units 15 each consisting of a gripper 13 and gripper pad 14 are provided to each gripper bar 10 to be parallel to each other in the axial direction. A sheet 16, the leading edge of which has been subjected to gripping change from grippers provided to the printing cylinder 4 of the final printing unit to the gripper units 15 of the delivery chains 6, is conveyed in the direction of arrow A as the gripper units 15 travel.

As shown in FIG. 1, paper guides 17, 18, and 19 divided into three in the convey direction of the sheet 16 are sequentially supported under the convey path of the sheet 16 along the convey path, and support and guide the sheet 16 which is being conveyed. Obliquely above that upright portion of the convey path of the sheet 16 which extends obliquely upward from the start ends of the delivery chains 6, a spray tube 20 serving as a powder spraying means connected to an air source (not shown) is supported between the pair of delivery frames 2.

The spray tube 20 has a plurality of spray nozzles 21 arranged parallel to each other. Powder sprayed from the spray nozzles 21 is blown to the sheet 16 which is being conveyed. A shielding cover 22 for covering the spray nozzles 21 extends between the pair of delivery frames 2 and is supported by the delivery frames 2. As shown in FIG. 3, the shielding cover 22 is formed of a spray cover portion 22*a* having a substantially crank-shaped section and one end close to the outer surface of a rotary member 30 (to be described later), and a rotary member cover portion 22*b* extending upward from one end of the spray cover portion 22*a* to cover the outer surface of the rotary member 30. A brush 23 is fixed to the other end of the spray cover portion 22*a* of the shielding cover 22. The distal end of the brush 23 is located to be in slidable contact with the traveling gripper units 15 upstream of the spray nozzles 21 in the sheet convey direction (direction of arrow A). More specifically, the shielding cover 22 covers the spray nozzles 21, thus covering a range from the upstream in the sheet convey direction to the rotary member 30.

In this embodiment, the cover portion 22*b* of the shielding cover 22 covers as far as the outer surface of the rotary member 30. Alternatively, only the cover portion 22*a* may be provided. It suffices if the powder 33 does not scatter from the gap between the shielding cover 22 and rotary member 30 downstream of the spray nozzles 21 in the sheet convey direction.

As shown in FIG. 1, a pile board 25 hung by elevating chains 24 from the horizontal portions 2*a* of the delivery frames 2, and a pile plate 26 placed on the pile board 25 are provided below the terminal ends of the delivery chains 6 in the sheet convey direction. The sheet 16 gripped by the gripper units 15 of the delivery chains 6 and conveyed by the travel of the delivery chains 6 is released by the gripper units 15 at the convey terminal end, and is dropped onto the pile plate 26 and stacked there. The delivery unit and powder apparatus described above are not different at all from those of the sheet-fed rotary printing press that are conventionally known.

The rotary member 30 as the characteristic feature of the present invention will be described. The rotary member 30 forms a substantially circular column, and is provided downstream of the spray tube 20 in the sheet convey direction, as shown in FIG. 3. Alternatively, the rotary member 30 may form a circular column with no hollow portion, or a circular column with a hollow portion, that is, a cylinder. A notch 31 which has a trapezoidal section and in which the corresponding gripper bar 10 and gripper units 15 can be fitted is formed in part of the outer surface of the rotary member 30 to extend entirely in the axial direction. The outer surface of the rotary member 30 excluding the notch 31 forms a guide surface 32 for guiding the sheet 16. The rotary member 30 is axially mounted on a rotary shaft 29 rotatably supported between the pair of delivery frames 2, and the rotary shaft 29 rotates as it is driven by the drive side. The rotary shaft 29 rotates such that the rotating direction and peripheral speed of the rotary member 30 become equal to the convey direction A and convey speed, respectively, of the sheet 16 which is conveyed as it is gripped by the gripper units 15.

The length of circumference of the rotary member 30 is set to be equal to the pitch of the gripper units 15 of the delivery chains 6. The rotation of the rotary member 30 is synchronized with the travel of the delivery chains 6 so that the gripper bars 10 and gripper units 15 driven to travel by the delivery chains 6 oppose the notch 31. Therefore, after one row of gripper units 15 of the delivery chains 6 opposes the notch 31 of the rotary member 30, when the rotary member 30 rotates by one turn, the next row of gripper units 15 opposes the notch 31 of the rotary member 30.

The rotary member 30 axially mounted on the rotary shaft 29 extends between the pair of delivery frames 2, and is positioned such that its guide surface 32 which forms the outer surface of the rotary member 30 comes close to the paper guide 18. More specifically, when the guide surface 32 of the rotary member 30 excluding the notch 31 opposes the sheet convey path, the gap formed between the guide surface 32 and paper guide 18 is set very small so that the sheet 16 can barely pass through it. In other words, this gap is set to be slightly larger than the thickness of the sheet 16.

The powder spraying operation of the powder apparatus with the above arrangement will be described.

After printing operation, the sheet 16 which has been subjected to gripping change from the grippers of the printing cylinder 4 of the final printing unit to the gripper units 15 of the delivery chains 6 is conveyed in the direction of the arrow A with its printing surface facing up, while it is supported by the paper guides 17 and 18. When one gripper bar 10 and corresponding gripper units 15 of the delivery chains 6 oppose the notch 31 of the rotary member 30, the leading edge of the sheet 16 opposes the spray nozzles 21, and powder 33 sprayed from the spray nozzles 21 is blown to the printing surface of the sheet 16.

Subsequently, the rotary member 30 rotates, so its guide surface 32 opposes the paper guide 18, and the gap formed between the paper guide 18 and guide surface 32 becomes very small. Hence, the paper guide 18 and guide surface 32 prevent the powder 33 from scattering downstream in the sheet convey direction, and the proportion (amount) of powder 33 fixed on the sheet 16 increases.

In addition, as the gap between the paper guide 18 and guide surface 32 is very small, when the sheet 16 passes through it, air flows 34 occur, as shown in FIG. 3. The air flows 34 drift toward the obverse side of the sheet 16. Thus, the powder 33 is reliably fixed on the sheet 16 by the air flows 34.

Furthermore, one end of the shielding cover 22 which covers the spray nozzles 21 comes close to the outer surface of the rotary member 30, and upstream of the spray nozzles 21 in the sheet convey direction, the distal end of the brush 23 comes into slidable contact with the traveling gripper units 15. Therefore, the powder 33 sprayed by the spray nozzles 21 is prevented from scattering toward the upstream side in the sheet convey direction by the shielding cover 22 and brush 23.

When the guide surface 32 of the rotary member 30 opposes the sheet convey path, the gap between the guide surface 32 and paper guide 18 is very small so that the conveyed sheet 16 can barely pass through it. Therefore, the sheet 16 will not be clamped by the guide surface 32 and paper guide 18 to wave, but is guided smoothly. As the rotating direction and peripheral speed of the rotary member 30 are equal to the convey direction A and convey speed, respectively, of the sheet 16 which is gripped by the gripper units 15, the guide surface 32 will not damage the printing surface of the sheet 16.

In the first embodiment, the rotary member 30 has one notch 31. Alternatively, the rotary member 30 may have a plurality of notches. In this case, the pitch of the plurality of notches is set to be equal to that of the gripper units 15.

Figure 4:
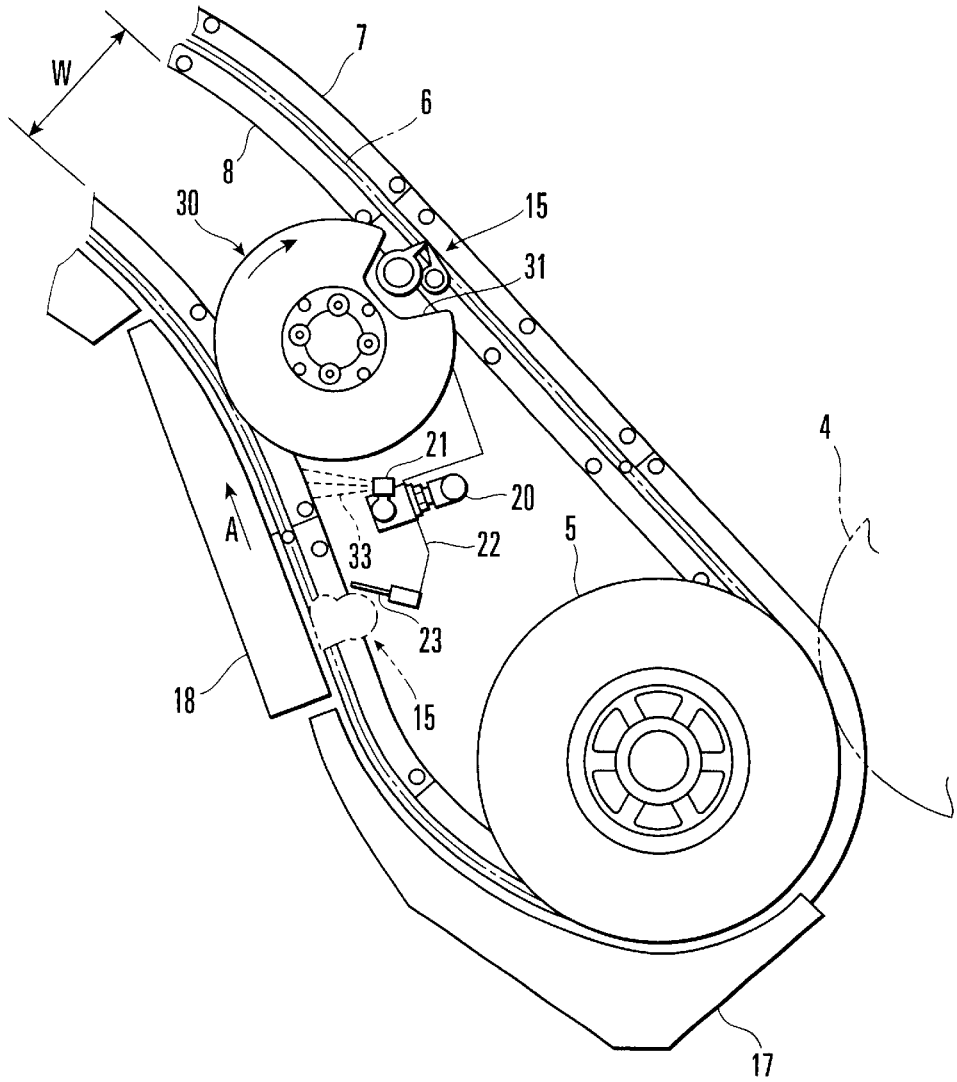
FIG. 4 is a side view of the main part showing a modification of the first embodiment of the present invention.

FIG. 4 shows a modification of the first embodiment. In this modification, a gap W formed by the opposing inner chain guides 7 and 8 is narrow, and the outer surface of a rotary member 30 opposes the return path of delivery chains 6. In this case, the positions, numbers of teeth, diameters, and the like of the sprockets 3 are set such that when a row of gripper units 15 which grip the sheet 16 and travel opposes the notch 31 of the rotary member 30, another row of gripper units 15 on the return path of the delivery chains 6 is located in the middle of rows of gripper units 15 which grip the sheet 16 and travel. Thus, the row of gripper units 15 which travel along the return path of the delivery chains 6 also opposes the notch 31 of the rotary member 30.

Figure 5:
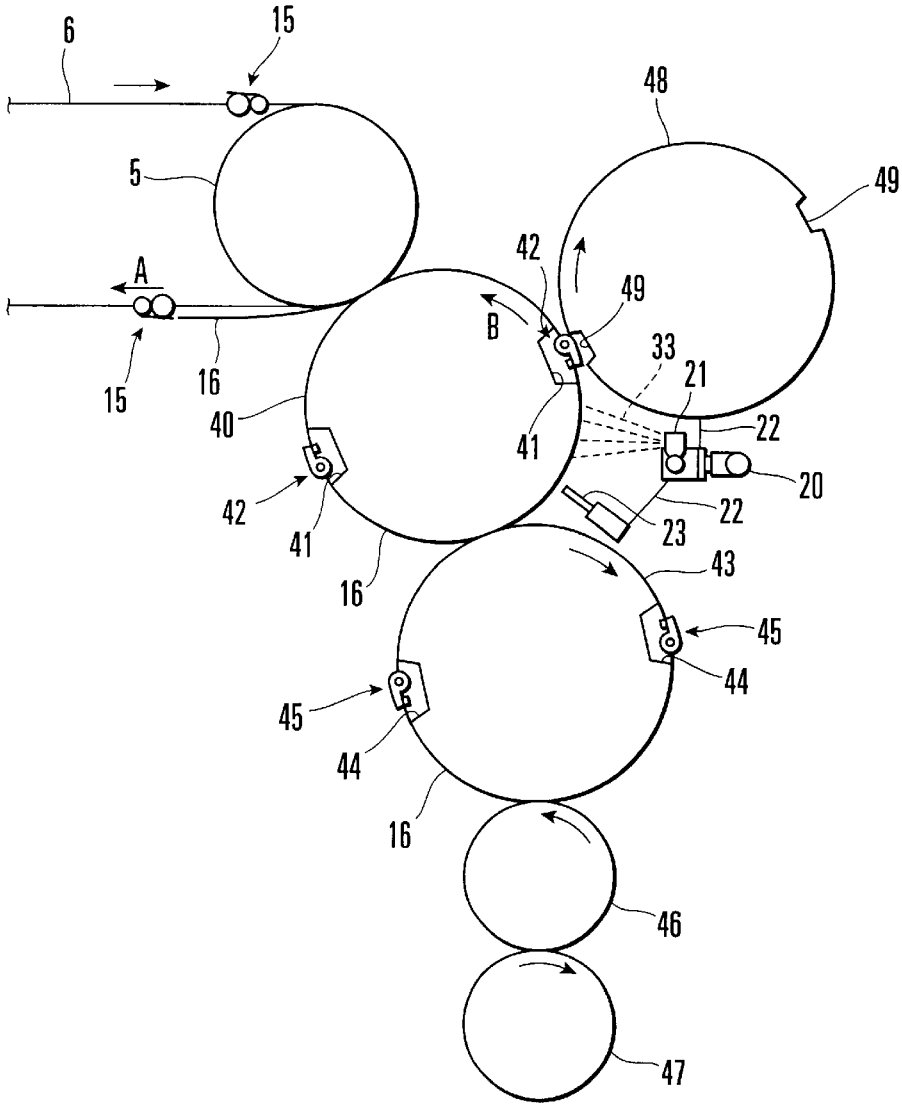
FIG. 5 is a layout view of cylinders to show the second embodiment of the present invention.

FIG. 5 shows the second embodiment of the present invention. In the second embodiment, the sheet conveying means is a transfer cylinder 40. Spray nozzles 21 spray powder 33 to the printing surface of a sheet 16 which is conveyed as it is gripped by grippers 42 of the transfer cylinder 40. More specifically, the transfer cylinder 40 is in contact with the outer surface of a delivery cylinder having end shafts on which sprockets 5 are axially mounted, and an impression cylinder 43 is in contact with the outer surface of the transfer cylinder 40. A pair of notches 41 are formed in the outer surface of the transfer cylinder 40 at positions that have an angular interval of 180° in the circumferential direction. The grippers 42 are provided in the respective notches 41.

A pair of notches 44 are formed in the outer surface of the impression cylinder 43 at positions that have an angular interval of 180° in the circumferential direction, and grippers 45 are provided in the respective notches 44. A blanket cylinder 46 is in contact with the outer surface of the impression cylinder 43, and a plate cylinder 47 is in contact with the outer surface of the blanket cylinder 46.

A rotary member 48, provided parallel to the transfer cylinder 40 such that their outer surfaces are at a small gap from each other, is rotatably supported downstream in the sheet convey direction (direction of an arrow B) from the spray nozzles 21 to the transfer cylinder 40. The rotary member 48 has the same diameter as that of the transfer cylinder 40, and rotates, when driven by the drive side, in the same direction as the sheet convey direction (direction of arrow B) of the transfer cylinder 40, i.e., clockwise in FIG. 5. The rotating speed of the rotary member 48 is also set equal to that of the transfer cylinder 40.

A pair of notches 49 are formed in the outer surface of the transfer cylinder 40 at positions that have an angular interval of 180° in the circumferential direction. When the rotary member 48 and transfer cylinder 40 rotate, the notches 49 oppose the grippers 42 of the transfer cylinder 40. More specifically, the distance between the notches 49 on the outer surface of the rotary member 48 is set equal to that of the grippers 42 on the outer surface of the transfer cylinder 40.

One end of a shielding cover 22 which covers the spray nozzles 21 is in contact with the outer surface of the rotary member 48. The distal end of a brush 23 fixed to the other end of the shielding cover 22 comes close to the outer surface of the transfer cylinder 40 in the upstream side of the transfer cylinder 40 in the sheet convey direction (direction of the arrow B).

With this arrangement, the surface of the sheet 16 is printed when the sheet 16 passes through the contact point between the blanket cylinder 46 and impression cylinder 43. After printing, the sheet 16 is subjected to gripping change from the grippers 45 of the impression cylinder 43 to the grippers 42 of the transfer cylinder 40, and is conveyed in the direction of arrow B by rotation of the transfer cylinder 40. While the sheet 16 is being conveyed by the transfer cylinder 40, the powder 33 is sprayed from the spray nozzles 21 to the printing surface of the sheet 16.

At this time, in the downstream side of the spray nozzles 21 in the sheet convey direction, the transfer cylinder 40 and rotary member 48 which oppose each other through a small gap can prevent the sprayed powder from scattering. Also, the shielding cover 22 for covering the spray nozzles 21, and the brush 23 can prevent the powder 33 from scattering outside. Thus, the proportion (amount) of powder 33 sprayed by the spray nozzles 21 and fixed on the sheet 16 increases.

In the second embodiment, the projecting amount of the grippers 42 of the transfer cylinder 40 as the sheet conveying means from the outer surface of the transfer cylinder 40 is small, which is smaller than the projecting amount of the gripper bars 10 from the delivery chains 6 in the first embodiment. Hence, the rotary member 48 can be brought close to the transfer cylinder 40 without forming in the rotary member 48 any notches 49 which oppose the grippers 42. When no notches 49 are formed in the rotary member 48 in this manner, they need not oppose the grippers 42 of the transfer cylinder 40. Thus, the diameter of the rotary member 48 need not be equal to that of the transfer cylinder 40, and a small-diameter cylinder can be used as the rotary member 48.

In this case, a rotary member can be provided in a space upstream of the spray nozzles 21 in the sheet convey direction in place of the shielding cover 22 and brush 23. When two rotary members are provided upstream and downstream of the spray nozzles 21 in the sheet convey direction, scattering of the powder 33 can be prevented more reliably. In the first and second embodiments, the powder 33 is sprayed to the surface of the sheet 16. Thus, the first and second embodiments can be applied to both double-sided printing and single-sided printing.

Figure 6:
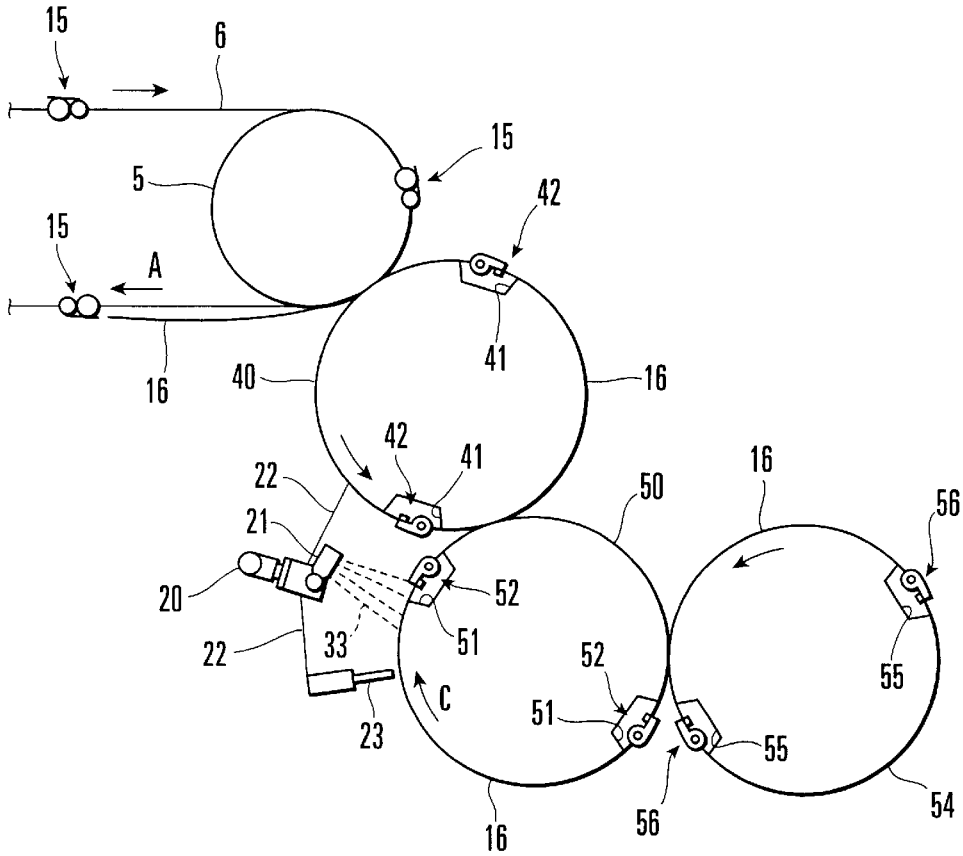
FIG. 6 is a layout view of cylinders to show the third embodiment of the present invention.

FIG. 6 shows the third embodiment of the present invention. In the third embodiment, double-sided printing is performed, and powder 33 is sprayed to the reverse side of the sheet. Between a transfer cylinder 40 as a rotary member and an impression cylinder 54, another transfer cylinder 50 serving as a sheet conveying means is provided. In this arrangement, while a sheet 16 is conveyed by the transfer cylinder 50, spray nozzles 21 spray the powder 33.

More specifically, the powder 33 sprayed from the spray nozzles 21 is blown to the reverse side of the sheet 16 which has been subjected to gripping change from grippers 56 formed in notches 55 of the impression cylinder 54 to grippers 52 formed in notches 51 of the transfer cylinder 50. Subsequently, the sheet 16 is subjected to gripping change from the grippers 52 of the transfer cylinder 50 to grippers 42 of the transfer cylinder 40, then to gripper units 15 of delivery chains 6, and is conveyed by the delivery chains 6 such that its reverse side faces down.

This arrangement can prevent the powder 33 sprayed by the spray nozzles 21 from scattering downstream of the contact position of the transfer cylinder 50 and transfer cylinder 40 in the sheet convey direction (direction of arrow C). As a shielding cover 22 which covers the spray nozzles 21 and a brush 23 can prevent the powder 33 from scattering outside, the proportion (amount) of powder 33 sprayed from the spray nozzles 21 and fixed on the sheet 16 increases.

According to this embodiment, the transfer cylinder 40, which is in contact with the transfer cylinder 50 and has the grippers 42 for receiving the sheet 16 from the grippers 52 of the transfer cylinder 50, is utilized as the rotary member. Thus, scattering of the powder 33 can be prevented with the existing arrangement. As a result, not only the structure is simplified, but also the number of components can be reduced. In this embodiment, the powder 33 is sprayed to the reverse side of the sheet 16. Hence, the third embodiment can be applied to double-sided printing, and single-sided printing in which the sheet is conveyed with its printing surface facing down.

In the second and third embodiments, the rotary member 40 or 48 has two notches 41 or 49, and two grippers 42 or 52 are provided as the sheet holding means. However, the present invention can also be applied to a case wherein the number of sets of the notches and that of the grippers are one. Although the convey target is a sheet, the present invention is not limited to this, but can also be applied a case wherein a plastic sheet or film is to be conveyed.

As has been described above, according to the present invention, the outer surface of a rotary member excluding a portion provided with a notch is brought close to a sheet which is being conveyed, and a minimum gap is formed between the outer surface of the rotary member and the paper guide. Therefore, the rotary member and paper guide can prevent scattering of the powder.

What is claimed is:

1. A powder apparatus for a printing press, comprising:

sheet conveying means having sheet holding means for holding and moving in a sheet convey direction a sheet having a printing surface;

powder spraying means for spraying powder toward the printing surface of the sheet which is being conveyed by said sheet conveying means; and a circular columnar rotary member provided downstream of said powder spraying means in the sheet convey direction and supported rotatably, said rotary member having at least one notch that opposes said sheet holding means, during rotation, which moves along with sheet convey operation.

2. An apparatus according to claim 1, wherein said apparatus further comprises a guide member, provided on a lower surface of a sheet convey path for the sheet which is conveyed by said sheet conveying means, to guide the sheet which is being conveyed, and said rotary member is arranged such that a gap between an outer surface of said rotary member and said guide member is slightly larger than a thickness of the sheet.

3. An apparatus according to claim 1, wherein the sheet which is conveyed by said sheet conveying means is guided by an outer surface of said rotary member.

4. An apparatus according to claim 1, wherein said sheet conveying means comprises a pair of endless convey chains for supporting two ends of said sheet holding means arranged in an axial direction of said rotary member.

5. An apparatus according to claim 4, wherein a gap between a convey path and return path of said convey chains is smaller than a diameter of said rotary member, and said sheet holding means supported by said convey chains opposes the notch of said rotary member on the return path.

6. An apparatus according to claim 1, wherein said sheet conveying means comprises a cylinder supported rotatably.

7. An apparatus according to claim 6, wherein said rotary member has second sheet holding means for holding a sheet.

8. An apparatus according to claim 1, wherein said apparatus further comprises a cover for covering said powder spraying means, and said cover covers a range from an upstream of said powder spraying means in the sheet convey direction to said rotary member.

9. An apparatus according to claim 1, wherein a rotating speed of said rotary member is set equal to a convey speed of said sheet conveying means.

10. An apparatus according to claim 1, wherein said sheet holding means comprises a plurality of gripper units supported equidistantly by said sheet conveying means in the sheet convey direction, the notch comprises one notch formed in an outer surface of said rotary member, and a length of circumference of said rotary member is set equal to a pitch of said gripper units.

11. An apparatus according to claim 1, wherein said sheet holding means comprises a plurality of gripper units supported equidistantly by said sheet conveying means in the sheet convey direction, the notch comprises a plurality of notches formed in an outer surface of said rotary member equidistantly, and a pitch of adjacent ones of the notches on the outer surface of said rotary member is set equal to a pitch of said gripper units.

* * * * *